US007615134B2

(12) United States Patent
Snekkenes et al.

(10) Patent No.: US 7,615,134 B2
(45) Date of Patent: Nov. 10, 2009

(54) METHOD AND ARRANGEMENT OF IMPREGNATING CHIPS

(75) Inventors: Vidar Snekkenes, Karlstad (SE); Lennart Gustavsson, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 341 days.

(21) Appl. No.: 11/691,586

(22) Filed: Mar. 27, 2007

(65) Prior Publication Data

US 2007/0187053 A1 Aug. 16, 2007

Related U.S. Application Data

(62) Division of application No. 10/498,470, filed on Jun. 10, 2004, now Pat. No. 7,381,302.

(30) Foreign Application Priority Data

Dec. 17, 2001 (SE) ..... 0104272-0
Dec. 16, 2002 (SE) ..... PCT/SE02/02330

(51) Int. Cl.
*D21C 3/26* (2006.01)

(52) U.S. Cl. ..... 162/17; 162/19; 162/52; 162/68; 162/237

(58) Field of Classification Search ..... 162/17, 162/19, 52, 68, 237, 239, 248, 250, 238
See application file for complete search history.

(56) References Cited

U.S. PATENT DOCUMENTS

| | | | | |
|---|---|---|---|---|
| 2,803,540 | A * | 8/1957 | Durant et al. | 162/236 |
| 3,330,088 | A | 7/1967 | Dulea | |
| 5,256,255 | A * | 10/1993 | Fagerlund | 162/237 |
| 5,635,025 | A | 6/1997 | Bilodeau | |
| 6,199,299 | B1 | 3/2001 | Prough et al. | |
| 6,280,567 | B1 | 8/2001 | Gustavsson et al. | |
| 6,284,095 | B1 | 9/2001 | Lebel et al. | |

FOREIGN PATENT DOCUMENTS

| | | |
|---|---|---|
| CA | 1154622 | 10/1983 |
| SE | 523850 | 5/2004 |

OTHER PUBLICATIONS

Sven Rydholm, "Continuous Pulping Processes", Technical Association of the Pulp and Paper Industry, 1970, p. 144.

* cited by examiner

*Primary Examiner*—Mark Halpern
(74) *Attorney, Agent, or Firm*—Rolf Fasth; Fasth Law Offices

(57) ABSTRACT

The method and an arrangement are for improved impregnation of chips in association with the manufacture of chemical cellulose pulp. Un-steamed chips are fed into an impregnation vessel (30) in which a fluid level (LIQ_LEV) is established under the highest level (CH_LEV) of the chips. An improved impregnation arrangement for the chips is obtained by the addition of impregnation fluids (BL1/BL2/BL3) with increasing temperatures at different heights (P1, P2, P3), and by the establishment of a counter-flow zone (Z1) in the uppermost part of the impregnation vessel. The requirement for steaming may in this way be dramatically reduced while at the same time the amount of expelled waste gases may be minimized. A major part of the volatile compounds present in the wood are bound to the impregnation fluid (REC) that is withdrawn.

8 Claims, 3 Drawing Sheets

FIG.3
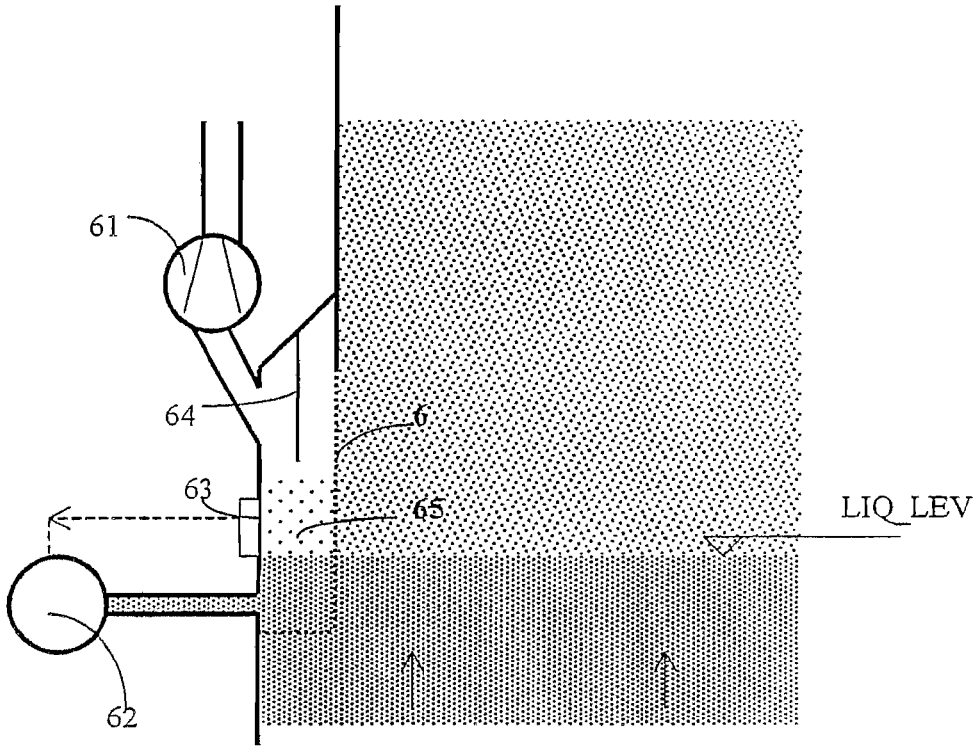
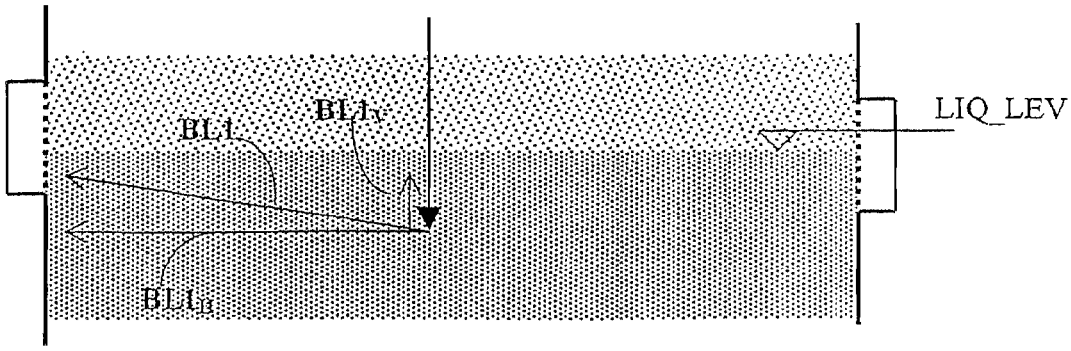
FIG.4

METHOD AND ARRANGEMENT OF IMPREGNATING CHIPS

PRIOR APPLICATION

This application is a divisional patent application of U.S. national phase application Ser. No. 10/498,470 filed 10 Jun. 2004 now U.S. Pat. No. 7,381,302 that is based on International Application No. PCT/SE02/002330, filed 16 Dec. 2002, claiming priority from Swedish Patent Application No. 0104272-0, filed 17 Dec. 2001.

FIELD OF INVENTION

The present invention concerns a method and an arrangement for impregnating chips during the manufacture of chemical pulp.

BACKGROUND INFORMATION

During the cooking of chemical cellulose pulp with continuous digesters it has been conventional to use a pre-treatment arrangement with a chip bin, steaming vessel and an impregnating chip chute, before the cooking process is established in the digester. Steaming has been carried out in one or several steps in the chip bin, prior to the subsequent formation of a slurry of the chips in an impregnation fluid or a transport fluid. The steaming has been considered to be absolutely necessary in order to be certain of expelling the air and water that is bound in the chips, such that the impregnation fluid can fully penetrate the chips, and such that air is not drawn into the system.

For example, U.S. Pat. No. 3,330,088 demonstrates the principle of such a system with a chip bin and a subsequent steaming vessel.

A great deal of development has taken place in order to optimise the steaming processing the chip bin, of which CA1154622, U.S. Pat. No. 6,199,299 and U.S. Pat. No. 6,284,095 only constitute examples of such development.

Attempts have been made to integrate the chip bin with the impregnation vessel in order to obtain in this manner a simpler system.

Already in U.S. Pat. No. 2,803,540, a system was revealed in which the chips from a chip bin were fed to a vessel in which a combined steaming and impregnation was achieved. In this vessel, the chips were steamed at the upper part of the vessel and impregnation fluid at the same temperature was added at various levels in the vessel.

These principles were applied in a process known as "Mumin cooking", which is described in "Continuous Pulping Processes", Technical Association of the Pulp and Paper Industry, 1970, Sven Rydholm, page 144. In this process, unsteamed chips were passed to a combined impregnation vessel, where steaming was obtained in the upper part, and to which impregnation fluid was added at a point in the upper part of the vessel during forced circulation. The impregnation fluid was in this case carried exclusively in the same direction of flow as the chips.

A system is shown in U.S. Pat. No. 5,635,025 in which the chips are fed without prior steaming to a vessel in the form of a combined chip bin, impregnation vessel and chip chute.

Steaming of the chips takes place here, the chips lying above the fluid level, and a simple addition of impregnation fluid takes place in the lower part of the vessel.

A further such system is revealed in U.S. Pat. No. 6,280,567, in which the chips are fed without prior steaming to an atmospheric impregnation vessel in which the chips are heated by the addition of warm black liquor that maintains a temperature around 130-140° C. The black liquor at high temperature is added just below the fluid level and is subjected to a reduction of pressure up through the bed of chips, after which foul-smelling released gases are removed from the top of the vessel. This creates large volumes of foul-smelling gases, which must be handled and destroyed in special systems. In this case, the impregnation fluid passes strictly in a concurrent flow direction, that is, impregnation fluid and chips move in a downwards direction.

An alternative system is revealed by SE,A,9802879-8, in which pressurised black liquor is added to the upper part of the steaming vessel, whereby the black liquor after being subjected to a pressure reduction releases steam for the steaming process. In this case, excess fluid, black liquor, can be drawn off from the lower part of the vessel.

The prior art has mostly exploited steaming as a major part of the heating of the chips, in which the steam that is used is either constituted by fresh steam or by steam flashed off from pressurised black liquor obtained from the cooking process. This involves a relatively large flow of steam, and its associated consumption of energy, and it requires a steaming system that can be regulated. The steaming has also involved the generation of large amounts of foul-smelling gases, and, at certain concentrations, a serious risk of explosion.

Problems arise when handling these volatile and readily condensed gases, which, for example, are constituted by turpentine and other hydrocarbons.

Special systems for handling these waste gases are required, and these must be dimensioned to cope with the volumes generated. Expensive systems with high capacity are required when these waste gases are created in large volumes.

THE OBJECT AND PURPOSE OF THE INVENTION

The principle object of the invention is to obtain an improved arrangement for the impregnation and heating of unsteamed chips, which arrangement does not demonstrate the disadvantages that are associated with other known solutions as described above.

A second object is to enable that the major part of the heating of the chips is made with impregnation fluid, a process that hereafter will be referred to as "fluid steaming" in which it is possible to obtain a natural reduction in temperature of the impregnation fluid by the establishment of an upper counterflow zone since the cold chips are progressively warmed by direct heat exchange during their downwards sinking motion in the vessel. In this way, it is possible in one preferred embodiment to balance the counterflow in this upper zone such that a suitable temperature is obtained in the upper part of the fluid zone, this temperature preferably being sufficiently low to prevent an extensive flashing of steam upwards through the bed of chips. This reduces the amount of foul-smelling gases released, these being to a large extent bound to the withdrawn impregnation fluid. A direct heat exchange with the cold sinking chips is obtained in the counterflow that is being considered, which is the reason that the impregnation fluid that is withdrawn can be maintained at such a low temperature that the volatile gases that are otherwise expelled can be retained in solution in the colder impregnation fluid, and finally withdrawn to a major degree together with the impregnation fluid.

A further object is to make it possible to control the heating process more accurately by the use of impregnation fluids with increasing temperatures at different positions down through the impregnation vessel, whereby the risk of steam blowing through the bed of chips is eliminated, while it is at the same time possible to obtain a high final temperature of the chips when in slurry form. This fluid steaming, which is thus established over a large section of the impregnation vessel, has surprisingly proved to expel the major part of the air and inert gases that are bound in the chips. In particular, when cooking eucalyptus and other easily cooked wood raw materials, and in cases when the chips maintain a temperature that is in excess of normal ambient temperature, i.e. over 20° C., the steaming operation using externally applied steam can be completely omitted.

In certain operational situations, such as the use of cold chips during the winter, light steaming may be necessary in order to raise the temperature of the chips to the normal value of 20-30° C., but with a severely reduced requirement for steaming compared with that needed by previously known technology.

A requirement for a certain degree of steaming may arise when using material that requires more cooking, such as softwood, with a high content of turpentine, etc., but this is severely reduced compared with that needed by previously known technology, and thus represents a major reduction in the volume of waste gases generated.

It was also an advantage if a withdrawal strainer was used, with which an efficient separation of not only foul-smelling gases but also impregnation fluid could be achieved. Much of the foul-smelling gases are bound to the withdrawn impregnation fluid when using the wet-steaming technology that is under consideration.

The invention can advantageously be used when cooking eucalyptus, bagasse and other annual plants, and it can also be used in association with the cooking of coniferous and deciduous pulp.

DESCRIPTION OF DRAWINGS

FIG. 3 shows a used withdrawal strainer;

FIG. 4 shows the establishment of a counterflow in the upper zone.

DETAILED DESCRIPTION OF PREFERRED EMBODIMENTS

Figure 1:
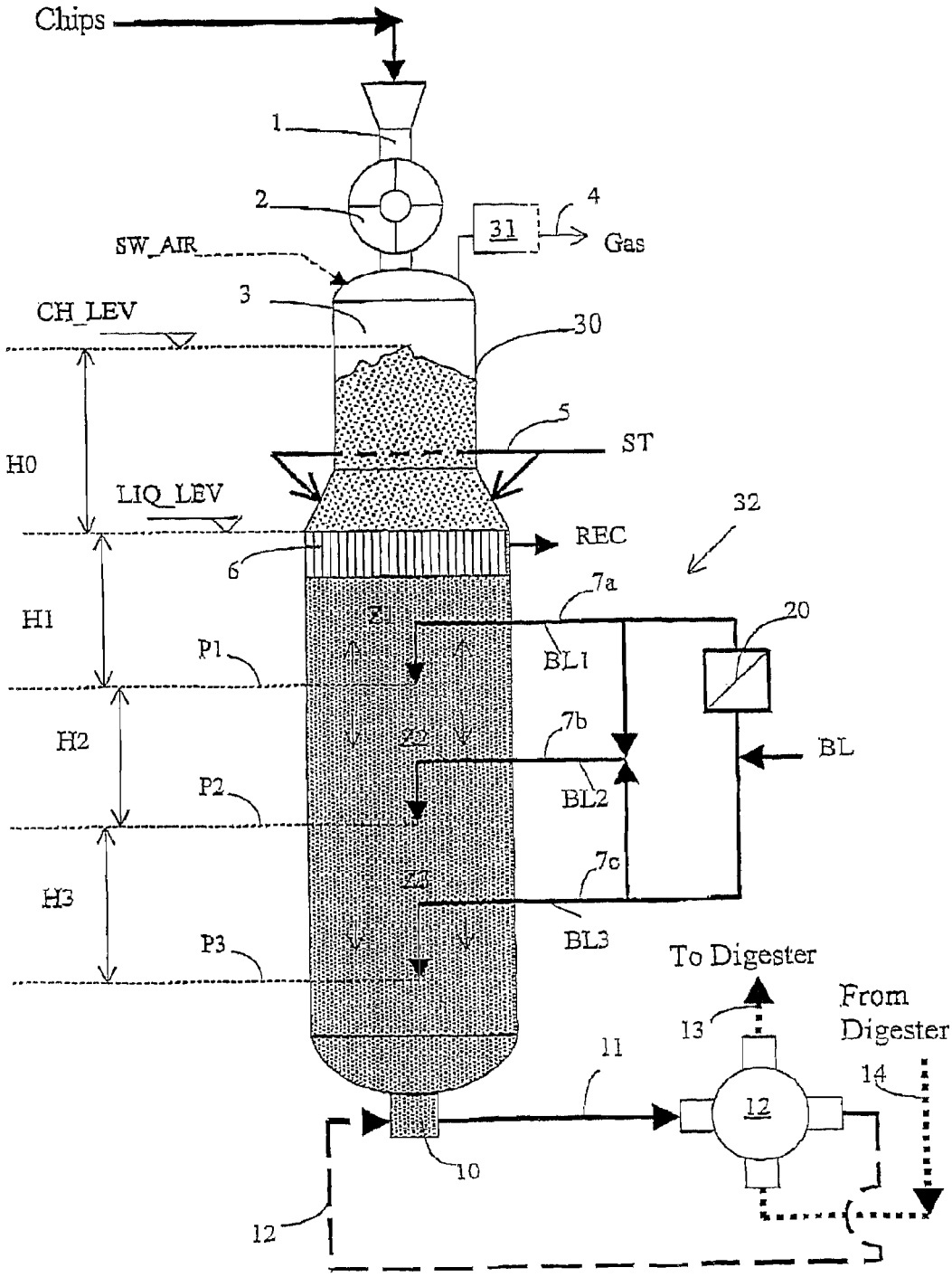
FIG. 1 shows an impregnation vessel according to the invention.

An arrangement for the impregnation of chips during the manufacture of chemical pulp is shown in FIG. 1. The arrangement comprises an essentially cylindrical impregnation vessel 30 arranged vertically into which unsteamed chips are continuously fed into the top of the impregnation vessel via feed means, in the form of a small chip bin 1 without steaming and a chute feed (chip feed) 2. The chips that are fed into the impregnation vessel are thus unheated chips that normally have the same temperature as the ambient temperature ±5° C.

The pressure in the vessel can be adjusted as necessary through a control valve 31 arranged in a valve line 4 at the top of the impregnation vessel, possibly also in combination with control of the steam ST via input lines 5. When atmospheric pressure is to be established, this valve line can open out directly to the atmosphere. It is preferable that a pressure is established at the level of atmospheric pressure, or a slight deficit pressure by the outlet 4 of magnitude −0.5 bar (−50 kPa), or a slight excess pressure of magnitude up to 0.5 bar (50 kPa). Input of a ventilating flow, SW_AIR (sweep air), can be applied at the top as necessary, which ensures the removal of any gases present.

The impregnated chips are continuously output via output means, here in the form of an outlet 10, possibly also in combination with bottom scrapers (not shown in the drawing), at the bottom of the impregnation vessel 30.

According to the invention, a first input line 7*a* with impregnation fluid BL1 is connected to the impregnation vessel at a first height P1 on the impregnation vessel corresponding to distance H1 below the strainer 6, which height is arranged under a maximum level LIQ_LEV of the chips in the impregnation vessel. The temperature of the impregnation fluid BL1 is adjusted by temperature-regulation means 32 to a first temperature before its addition at this first height, in this case a shunt circuit with cooled and with uncooled impregnation fluid. Furthermore, at least one other input line 7*b* with impregnation fluid is connected to the impregnation vessel at a second height, P2, corresponding to distance H1+H2 below the strainer 6, which second height is arranged under the first height P1 on the impregnation vessel. The temperature of the impregnation fluid is adjusted by temperature-regulation means 32 to a second temperature before its addition at this second height. This second temperature exceeds the first temperature by at least 5° C.

A withdrawal strainer 6 is arranged in the wall of the impregnation vessel 30 at a height above the first height, whereby a maximum liquid level LIQ_LEV can be established in the impregnation vessel under the highest level CH_LEV of the chips in the impregnation vessel. Control of the level occurs by adjusting the balance between the addition of impregnation fluid BL1, BL2, (BL3) through the input lines 7*a*, 7*b*, (7*c*) and the current withdrawal REC through the withdrawal strainer 6 and output from the bottom 10. The liquid level must thus be established such that it lies under the highest level CH_LEV of the chips in the impregnation vessel. The level CH_LEV of the chips above the level LIQ_LEV of the liquid must be at least 2 metres and preferably at least 5 metres when impregnating eucalyptus. In the case of wood raw material of lower density, for example, softwood, which has a density that is up to 30% lower, a corresponding increase in the height of the column of chips over the surface of the fluid is established. This height is important in order to provide an optimal passage of the chips in a column.

Since the outlet 6 for impregnation fluid is located at a position in the impregnation vessel that lies above the position for addition of the first impregnation fluid BL1, a flow in the opposite direction to the sinking motion of the chips is established, indicated by lightly drawn upwards-pointing arrows in FIG. 1, in at least the upper part of the fluid-filled zone Z1 in the impregnation vessel 30.

It is appropriate that the temperature of the first impregnation fluid BL1, the first temperature, lies within the interval 105±5° C., and it is appropriate that addition of the first impregnation fluid takes place through a first input line 7*a* under a liquid level LIQ_LEV that has been established by added impregnation fluid in the impregnation vessel 30 at a position in the impregnation vessel at which the ambient pressure corresponds to or exceeds the saturation pressure, which corresponds at a temperature of 105° C. to a level at least 2 metres under the established liquid level LIQ_LEV if the impregnation vessel is not subject to an externally applied pressure.

The temperature of the second impregnation fluid BL2, the second temperature, lies within the interval 120±10° C. and addition of the second impregnation fluid through the second input line 7*b* occurs under the position of addition in the impregnation vessel of the first input line, and at a position in the impregnation vessel at which the ambient pressure corresponds to or exceeds the saturation pressure, which corresponds at a temperature of 125° C. to a level at least 13 metres under the established liquid level LIQ_LEV if the impregnation vessel is not subject to an externally applied pressure.

It is advantageous if at least one third input line 7*c* with impregnation fluid is connected to the impregnation vessel at a third height, P3, corresponding to distance H1+H2+H3 under the strainer 6, which third height is arranged under the second height P2 on the impregnation vessel. The temperature of the impregnation fluid is adjusted by temperature-regulation means 32 to a third temperature before its addition at this third height. This third temperature exceeds the second temperature by at least 5° C.

The temperature of the third impregnation fluid BL3, the third temperature, lies within the interval 130±15° C. Addition of the third impregnation fluid occurs through the third input line 7*c* under the position of addition in the impregnation vessel of the second input line, and at a position in the impregnation vessel at which the ambient pressure corresponds to or exceeds the saturation pressure, which corresponds at a temperature of 130° C. to a level at least 17 metres under the established liquid level LIQ_LEV if the impregnation vessel is not subject to an externally applied pressure.

It is preferable that the added impregnation fluid is obtained from a common flow of withdrawn black liquor BL, preferably a withdrawal of black liquor directly from a subsequent digester or via a pressurised impregnation stage. It is appropriate if this withdrawn black liquor BL is constituted by a non-pressurised withdrawal flow direct from the digester, or from a pressurised impregnation stage.

FIG. 1 shows that the first, second and third impregnation fluids, BL1, BL2 and BL3, are to a major degree established from a common flow BL of black liquor that has been withdrawn from a subsequent cooking stage. It is appropriate if this flow is constituted by more than 50%, preferably more than 75%, of black liquor from the digester.

Temperature control of the different temperature levels is obtained by the use of a shunt circuit 32. This controls the common original flow BL in such a manner that the first impregnation fluid BL1 is set to the first temperature by cooling means 20. The cooling means may be an indirect heat exchanger, a pressure drop cyclone or another form of evaporative cooling, or the addition of cold fluid, preferably colder process fluids, basic or washing filtrate.

The third impregnation fluid BL3 can be obtained directly from the common flow BL of black liquor at the existing temperature of the black liquor. If this temperature is initially too high, cooling of the common flow BL can, naturally, take place first.

The temperature of the second impregnation fluid BL2 is set by the mixing by means of mixing means, suitably by simple flow regulation in the shunt circuit 32 in a known manner, of the cooled flow BL1 and the non-cooled sub-flow BL3 of black liquor.

Even though steaming is not required for readily cooked pulps such as eucalyptus and annual plants, at a normal outdoor around 20° C., addition of extra steam ST can take place through addition means 5 arranged in the wall of the impregnation vessel, or through central pipes, above the fluid level LIQ_LEV established by the impregnation fluid.

Through the arrangement according to the invention using fluid steaming, it is possible to apply a method for the impregnation of chips during the manufacture of chemical pulp in which the chips, without preceding steaming with steam, are continuously fed into the top of an impregnation vessel, in which a pressure, at essentially the same pressure as atmospheric pressure, ±0.5 bar, is established at the top, and from which impregnated chips are continuously fed out from the bottom of the vessel. The chips are subsequently warmed in an upper fluid-filled zone Z1 of the impregnation vessel by the addition of a first impregnation fluid BL1 at a first temperature. The chips are subsequently warmed in a second fluid-filled zone Z2, under the upper zone, by the addition of at least one second impregnation fluid BL2 at a second temperature that exceeds the first temperature by at least 5° C. A flow of impregnation fluid in the direction opposite to the sinking motion of the chips is established in at least the upper zone Z1 of the impregnation vessel by the establishment in the impregnation vessel of a fluid level LIQ_LEV through the addition and withdrawal of impregnation fluid, where the fluid level lies below the maximum level CH_LEV reached by the chips in the impregnation vessel, and by the withdrawal REC of impregnation fluid taking place at a position in the impregnation vessel above the location of addition of the first impregnation fluid.

A better and more accurately controlled heating of the chips can be achieved with this method, during simultaneous impregnation with successively warmer impregnation fluids.

The first temperature of BL1 is adjusted such that the temperature appropriately exceeds 100° C., preferably within the interval 100-110° C., and addition of the first impregnation fluid takes place under a fluid level in the impregnation vessel that has been established by the added impregnation fluid at a position in the impregnation vessel at which the ambient pressure corresponds to or exceeds the saturation pressure. The second temperature of BL2 exceeds 110° C., preferably within the interval 110-130° C., and addition of the second impregnation fluid takes place under the position of addition of the first impregnation fluid in the impregnation vessel, and at a position in the impregnation vessel at which the ambient pressure corresponds to or exceeds the saturation pressure. In one preferred embodiment, shown in the drawing, the chips are heated in a third fluid-filled zone Z3 under the second zone by the addition of a third impregnation fluid BL3 at a third temperature that exceeds the second temperature by at least 5° C. The third temperature is adjusted to exceed 115° C., preferably within the interval 115-145° C., and addition of the third impregnation fluid takes place under the position of addition of the second impregnation fluid in the impregnation vessel, and at a position in the impregnation vessel at which the ambient pressure corresponds to or exceeds the saturation pressure.

An impregnation vessel that is at least 25 metres high, preferably 30-50 metres high, is used in one implementation of the method.

The upper part of the impregnation vessel above the strainer 6, the height of the chips H0 together with the empty volume above, can correspond to at least 6 metres (3+3 metres), and a more advantageous approximately 8 metres (5 metres chip height+3 metres empty volume, buffer volume). Impregnation fluids with progressively increasing temperatures are added according to the invention at increasing distances below the strainer 6 and below the established fluid level LIQ_LEV.

With atmospheric pressure, approximately 100 kPa (1 bar), at the top of the impregnation vessel, the first impregnation fluid having the lowest temperature, a temperature, however, that must exceed 100 degrees, is added at a position at which the hydrostatic pressure from the column of fluid that lies above it corresponds to or exceeds the saturation pressure.

At a temperature of BL1 of 105° C., this corresponds to a saturation pressure of 120.8 kPa, that is, a fluid column of just over 2 metres height. Thus the line 7*a* must open at a location more than 2 metres below the fluid level LIQ_LEV that has been established.

At a temperature of BL2 of 125° C., this corresponds to a saturation pressure of 232.1 kPa, that is, a fluid column of just over 13 metres height. Thus the line 7*b* must open at a location more than 13 metres below the fluid level LIQ_LEV that has been established.

At a temperature of BL3 of 130° C., this corresponds to a saturation pressure of 270.1 kPa, that is, a fluid column of approximately 17 metres height. Thus the line 7*c* must open at a location more than 17 metres below the fluid level LIQ_LEV that has been established.

Naturally, more or fewer additions of impregnation fluids can take place through the impregnation vessel. However, according to the invention, these must always be added such that pressure reduction does not take place, with its associated risk of steam blowing through up through the column of chips, which can disturb the passage of chips and generate foul-smelling gases that are expelled from the chips and are not bound in the withdrawn impregnation fluid REC.

The following table gives suitable positions for the addition of different impregnation fluids at different temperatures, at atmospheric pressure or at a pressure of ±0.5 bar at the top of the impregnation vessel.

| Temperature of impregnation fluid | Saturation pressure kPa | Height under fluid level, with atm pressure at top | Height under fluid level, with +50 kPa at top | Height under fluid level, with −50 kPa at top |
|---|---|---|---|---|
| 105° C. | 120.8 | >2 metre | — | >7 metre |
| 110° C. | 143.3 | >4.3 metre | — | >9.3 metre |
| 115° C. | 169.1 | >6.9 metre | >1.9 metre | >11.9 metre |
| 120° C. | 198.5 | >9.8 metre | >4.8 metre | >14.8 metre |
| 125° C. | 232.1 | >13.2 metre | >8.2 metre | >18.2 metre |
| 130° C. | 270.1 | >17.0 metre | >12 metre | >23 metre |
| 135° C. | 313.0 | >23.3 metre | >18.3 metre | >28.3 metre |
| 140° C. | 361.3 | >26.1 metre | >21.1 metre | >31.1 metre |
| 145° C. | 415.4 | >31.5 metre | >26.5 metre | |

The first, second and third impregnation fluids, BL1, Bl2 and BL3 are in the method according to the invention principally established from one common flow of black liquor that has been withdrawn from a subsequent cooking stage. It is appropriate that the black liquor, which already has a high temperature when withdrawn form the digester, constitutes more than 50% and preferably more than 75% of the impregnation fluid. Energy can be managed in this way in an efficient manner.

The relevant subflows BL1, BL2 and BL3 with different temperatures are obtained in that the common flow BL is divided into at least two flows: one cooled flow and one non-cooled flow. The temperature of the first impregnation fluid BL1 is adjusted by cooling the black liquor BL. The third impregnation fluid BL3 is obtained directly from the common flow of black liquor. The temperature of the second impregnation fluid BL2 is adjusted by mixing the cooled flow and the non-cooled flow of black liquor.

When impregnation primarily easily cooked types of wood, such as eucalyptus and other annual plants, steaming can be essentially avoided. Steam is thus not added to the chips that lie on top of the fluid level established by the impregnation fluid during normal steady-sate operation. The invention can also be applied even if coniferous and deciduous wood (softwood and hardwood) are used as raw material, giving a markedly reduced need for steaming, that is, a reduced addition of steam.

When treating primarily wood raw material that is difficult to cook, coniferous and deciduous wood, and in operational cases with extremely low temperature of the chips, (such as during the winter), the chips that lie above the fluid level established by the impregnation fluid can be heated by the addition to the impregnation vessel of external steam such that a temperature of the chips of at least 20° C. and of 80° C. at the most is obtained on the chips before the chips reach the fluid level that has been established by the impregnation fluid.

Figure 2:
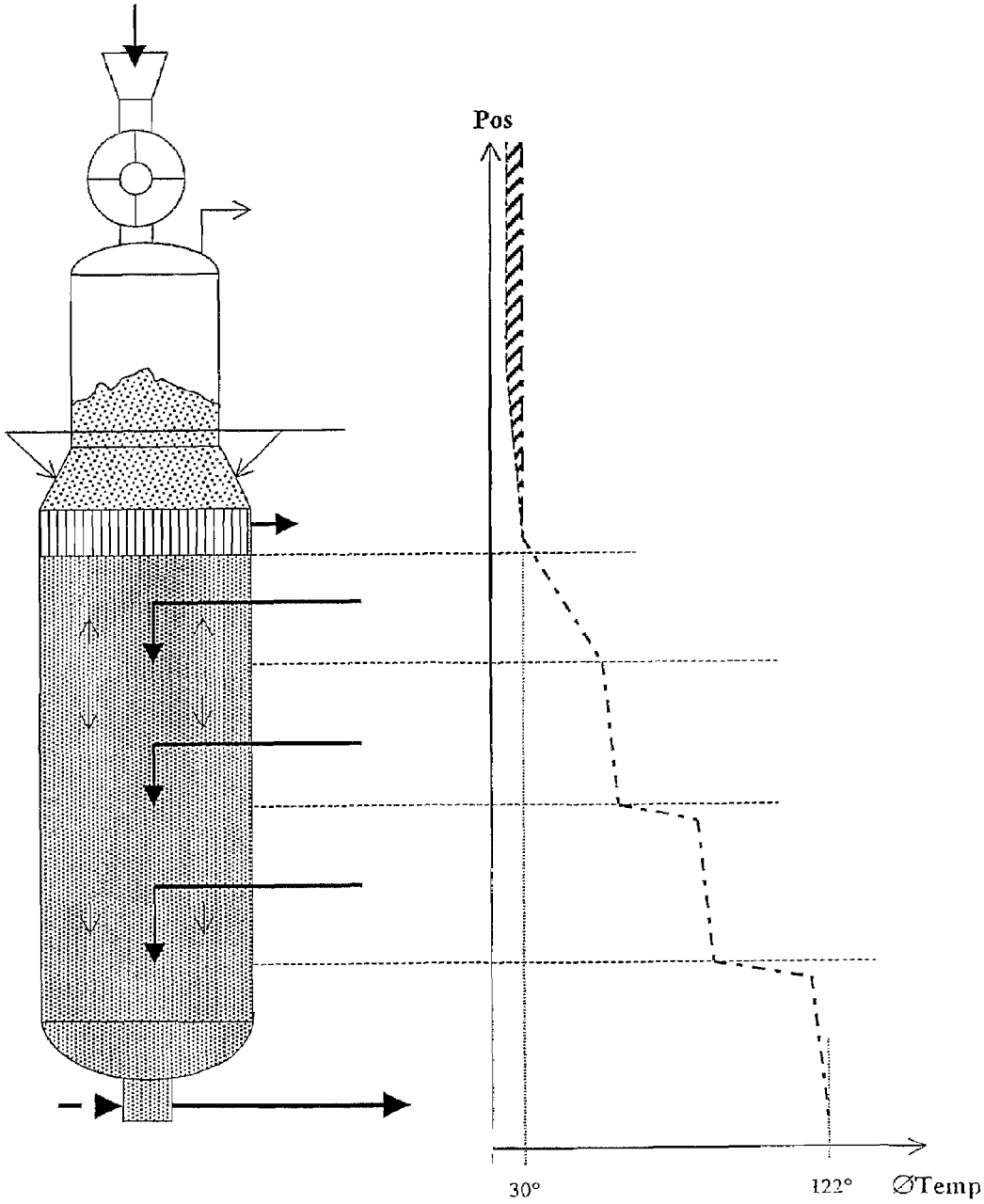
FIG. 2 shows schematically the temperature profile in the impregnation vessel.

FIG. 2 shows schematically the temperature profile in the impregnation vessel during the use of an arrangement equivalent to that shown in FIG. 1, when operating conditions are advantageous. The reduced energy supply that is required to raise the temperature by steaming from a low chip temperature to the standard value of 30° C. is shown in the drawing as the diagonally shaded area. This case is based on chips with a moisture content around 35%, a temperature of approximately 30° C. and a production amount of 1500 ADMT/day. In this case, an input of 0.68 tonne/tonne of wood moisture is obtained, that is, 0.68 tonnes of wood moisture per tonne of chips accompanies the chips.

The arrangement can be adjusted such that the temperature of the impregnation fluid REC that is withdrawn lies around 30° C. The following standard amounts and temperatures apply in these operational conditions:

BL1: 105° C., and a flow of 2.85 tonne/hour

BL2: 125° C., and a flow of 1.5 tonne/hour

BL3: 132° C., and a flow of 1.5 tonne/hour

REC: 30° C., and a flow of 0.96 tonne/tonne (i.e. 0.96 tonne fluid per tonne of chips).

A temperature of the mixture of approximately 117° C. is obtained under these conditions, which, together with the exothermic reaction with the black liquor, which corresponds to a temperature rise of approximately 5° C., ensures a final temperature of approximately 122° C. of the chips when fed out from the impregnation vessel.

At this level of the flow in the counterflow zone Z1, which preferably lies within the interval 50-150% of the flow of chips, calculated as a weight percentage, i.e. that 0.50-1.50 tonnes of fluid per tonne of chips is withdrawn at the flow REC, a first heating of the chips is obtained in direct heat exchange between the chips and the counterflow of impregnation fluid, which means that the temperature of the impregnation fluid is gradually reduced up through the zone Z1 from its value of 105° C. down to 30° C. By adjusting the withdrawal flow, or by adjusting the cooling (in the heat exchanger 20), the withdrawal temperature can be maintained essentially constant at such a low value that the impregnation fluid does not cause evaporation of the volatile components of the chips, and/or the black liquor, and instead binds these in the impregnation fluid, with these components being successively withdrawn through the withdrawal flow REC.

FIG. 3 shows an advantageous design of the withdrawal strainer 6, which can be used in association with the fluid steaming system according to the invention. The withdrawal strainer 6 withdraws impregnation fluid from a fluid steaming arrangement according to FIG. 1, but is here arranged in the wall of the vessel directly prior to an increase in diameter of the vessel in a conventional manner. The unsteamed chips lie above the fluid level LIQ_LEV in the form of columns of chips with a predetermined height. The fluid level LIQ_LEV is established with the aid of a level sensor 63 that controls the evacuation pump 62 in the lower outlet. The region behind the withdrawal strainer 6 external to the column of chips is divided into an upper and a lower region, whereby a first evacuation channel is connected, via a pump or ejector 61, to the upper part of the region, and a second evacuation channel is connected, via a pump 62, to the lower part of the region, for evacuation of volatile gases (and/or foam 65) and impregnation fluid in the different evacuation channels. An unlinking plate 64 can be mounted in order to prevent that part of the column of chips that has not yet reached the fluid level from being subjected to too great a deficit of pressure. It is also possible for the pump 62 to drive an ejector 61 such that the fluid that is withdrawn via the pump 62 carries foam and gases with it.

FIG. 4 shows how a counterflow of impregnation fluid can be established by the addition of the first impregnation fluid BL1. If a lower temperature of around 100° C. is used for the first impregnation fluid BL1, the addition can take place directly under the established fluid level LIQ_LEV, with the subsequent withdrawal radially external to the level of addition P1. In this case it is important to establish at least one radial flow BL1, with a vertical component of flow $BL1_V$ and a horizontal component of flow $BL1_H$. It is preferable that the ratio of $BL1_V$ to $BL1_H$ is maintained above a minimum value 1:10 if the temperature lies around 100° C. and under atmospheric conditions in an impregnation vessel with a diameter of 6 metres. At an increased temperature around 105° C. and under atmospheric conditions in an impregnation vessel of diameter 6 metres, the ratio of $BL1_V$:$BL1_H$ can correspond to 2:3.

The invention can be modified in a number of ways within the framework of the attached claims. Considerably more than 2-3 impregnation fluids of different temperatures can be added at different heights in the impregnation vessel, either through central pipes (that open out in the centre of the column of chips) or through inlet nozzles in the wall of the vessel. In the same manner, several locations of addition (different heights) of impregnation fluid at the same temperature can be used, in particular in the lower part of the impregnation vessel.

Withdrawal strainers in addition to that shown in FIG. 1, strainer 6, can be used in the lower part of the impregnation vessel. This is particularly true if very high fluid/woods ratios are established in the impregnation vessel, and if the fluid/wood ratio is to be reduced in the outlet or if another fluid is to replace the impregnation fluid in association with the output. The impregnation fluids BL1, BL2 and BL3 can also be established from totally separate sources, that is, not from one common flow BL of black liquor. For example, BL1 may be a wash filtrate, obtained, for example, from the washing zone of the digester, while BL2/BL3 may be impregnation fluid obtained from the cooking circuits of the digester.

The impregnation fluids can also be provided with a basic supplement with the object of establishing alkali profiles that are necessary for the process, in particular if the residual alkali in the black liquor is low. A rapid initial consumption of alkali normally takes place, while it is desired to keep the final withdrawal REC low. This is the reason that progressively increasing supplements of alkali can be added to the impregnation fluids as the chips successively sink downwards through the impregnation vessel.

It is appropriate if the flow REC withdrawn from the impregnation vessel is carried directly to evaporation/recycling.

It is also possible that more than one counterflow zone can be established in the upper fluid-filled part of the impregnation vessel.

An additional supplement of colder impregnation fluid, in the region 60-90° C., may also be added at the top of the fluid-filled counterflow zone. This fluid at a lower temperature can be added continuously or it can be added as required.

While the present invention has been described in accordance with preferred compositions and embodiments, it is to be understood that certain substitutions and alterations may be made thereto without departing from the spirit and scope of the following claims.

The invention claimed is:

1. A method for the impregnation of chips during the manufacture of chemical pulp comprising:

(a) continuously feeding chips without preceding steaming to a top of an impregnation vessel in which a pressure at essentially atmospheric pressure, ±0.5 bar, is established at the top, and continuously feeding out impregnated chips at a bottom of the impregnation vessel, providing a first impregnation fluid having a first temperature and a second impregnation fluid having a second temperature, (b) heating the chips in an upper fluid-filled zone of the impregnation vessel by adding the first impregnation fluid at the first temperature, (c) heating the chips in a second fluid-filled zone under the upper fluid-filled zone by adding the second impregnation fluid at the second temperature that exceeds the first temperature by at least 5° C., (d) establishing a fluid level in the impregnation vessel by adding and withdrawing impregnation fluid, establishing the fluid level such that the fluid level lies under a chip-level of the chips in the impregnation vessel, and withdrawing impregnation fluid at a position in the impregnation vessel above a position of addition of the first impregnation fluid, establishing a flow ($BL1_V$) of impregnation fluid in a direction opposite to a sinking motion of the chips in at least an upper part of the impregnation vessel.

2. The method according to claim 1 wherein the first temperature exceeds 100° C. and the addition of the first impregnation fluid takes place under a fluid level that has been established by the added impregnation fluid at a position in the impregnation vessel at which an ambient pressure corresponds to or exceeds a saturation pressure.

3. The method according to claim 2 wherein the second temperature exceeds 110° C. and the addition of the second impregnation fluid takes place under the position at which the first impregnation fluid is added, and at a position in the impregnation vessel at which the ambient pressure corresponds to or exceeds the saturation pressure.

4. The method according to claim 3 wherein the chips are heated in a third fluid-filled zone under the second zone by an addition of a third impregnation fluid at a third temperature that exceeds the second temperature by at least 5° C.

5. The method according to claim 4 wherein the third temperature exceeds 115° C. and the addition of the third impregnation fluid takes place under the position at which the second impregnation fluid is added to the vessel, and at a position in the impregnation vessel at which the ambient pressure corresponds to or exceeds the saturation pressure.

6. The method according to claim 5 wherein the first, second and third impregnation fluids are principally established, to a degree of at least 50% from a common flow of black liquor that has been withdrawn from a subsequent cooking stage, the method further comprises (a) adjusting the temperature of the first impregnation fluid by cooling the black liquor, (b) obtaining the third impregnation fluid directly from the common flow of black liquor, and (c) adjusting the temperature of the second impregnation fluid by mixing a flow of black liquor that has been cooled in step (a) and the non-cooled flow from step (b).

7. The method according to claim 1 wherein the chips, that lie over the fluid level established by the impregnation fluid during normal steady-state operation, are not heated by an addition of extra steam to the impregnation vessel.

8. The method according to claim 1 wherein the chips that lie above the fluid level established by the impregnation fluid are heated by an addition of steam to the impregnation vessel such that a temperature of the chips of minimum 20° C. and maximum 80° C. is obtained before the chips reach the fluid level established by the impregnation fluid.

* * * * *